US008326172B2

(12) United States Patent
Nishikawa

(10) Patent No.: US 8,326,172 B2
(45) Date of Patent: Dec. 4, 2012

(54) HEAT INSULATION STRUCTURE AND IMAGE FORMING APPARATUS USING THE SAME

(75) Inventor: Satoru Nishikawa, Kanagawa (JP)

(73) Assignee: Fuji Xerox Co., Ltd, Tokyo (JP)

( * ) Notice: Subject to any disclaimer, the term of this patent is extended or adjusted under 35 U.S.C. 154(b) by 208 days.

(21) Appl. No.: 12/814,083

(22) Filed: Jun. 11, 2010

(65) Prior Publication Data

US 2011/0110679 A1 May 12, 2011

(30) Foreign Application Priority Data

Nov. 12, 2009 (JP) ..... 2009-259280

(51) Int. Cl.
*G03G 21/20* (2006.01)

(52) U.S. Cl. ..... 399/92

(58) Field of Classification Search ..... 399/92, 399/122

See application file for complete search history.

(56) References Cited

U.S. PATENT DOCUMENTS 7,945,186 B2 * 5/2011 Kimura ..... 399/92
2006/0269314 A1 * 11/2006 Lee et al. ..... 399/92

FOREIGN PATENT DOCUMENTS

JP A-11-38804 2/1999
JP A-2001-5354 1/2001
JP A-2002-372883 12/2002

* cited by examiner

*Primary Examiner* — Walter L Lindsay, Jr.
*Assistant Examiner* — Frederick Wenderoth
(74) *Attorney, Agent, or Firm* — Oliff & Berridge, PLC

(57) ABSTRACT

A heat insulation structure includes: a duct member disposed above a fixing device that fixes developer onto a recording medium, through which air flows to be exhausted; a heat insulating member disposed between an upper side of the duct member and a lower side of a function member disposed above the duct member; and a gap forming member that forms a gap between the duct member and the heat insulation member in a vertical direction.

4 Claims, 7 Drawing Sheets

HEAT INSULATION STRUCTURE AND IMAGE FORMING APPARATUS USING THE SAME

CROSS-REFERENCE TO RELATED APPLICATION

This application is based on and claims priority under 35 USC 119 from Japanese Patent Application No. 2009-259280 filed Nov. 12, 2009.

BACKGROUND

Technical Field

The present invention relates to a heat insulation structure and an image forming apparatus using the heat insulation structure.

SUMMARY

According to an aspect of the present invention, there is provided a heat insulation structure including: a duct member disposed above a fixing device that fixes developer onto a recording medium, through which air flows to be exhausted; a heat insulating member disposed between an upper side of the duct member and a lower side of a function member disposed above the duct member; and a gap forming member that forms a gap between the duct member and the heat insulation member in a vertical direction.

BRIEF DESCRIPTION OF THE DRAWINGS

An exemplary embodiments of the present invention will be described in detail based on the following figures, wherein.

DETAILED DESCRIPTION

An example of a heat insulation structure and an image forming apparatus according to an exemplary embodiment of the present invention will be described.

Figure 1:
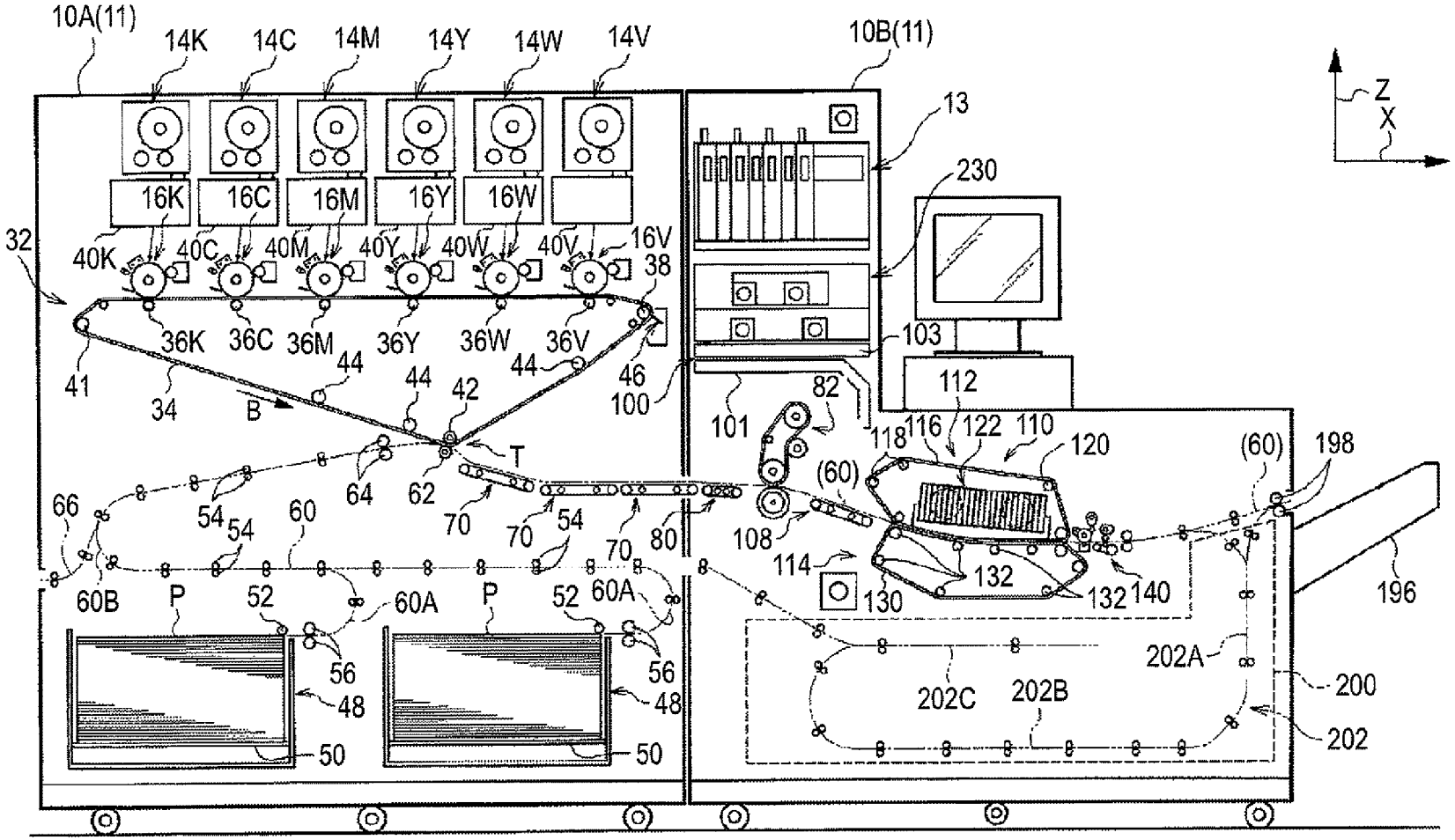
FIG. 1 is a diagram showing the overall configuration of an image forming apparatus according to an exemplary embodiment of the present invention.

As shown in FIG. 1, an image forming apparatus according to this exemplary embodiment forms a color image or a monochromatic image, and it has a first processor 10A disposed at the left side in front view, and a second processor 10B that is disposed at the right side so as to be attachable/ detachable to/from the first processor 10A. The first processor 10A and the second processor 10B have housings 11 containing plural frame members 15 (see FIG. 5).

A controller 13 is provided at the upper side in the vertical direction in the second processor 10B. The controller 13 contains an image signal processor for executing image processing on image data transmitted from a computer and controls the driving of each part of the image forming apparatus 10. A power supply unit 230 as an example of a function member is provided at the lower side of the controller 13. The power supply unit 230 converts AC current taken from the external to DC current, and supplies power to the respective parts of the image forming apparatus 10.

Furthermore, toner cartridges 14V, 14W, 14Y, 14M, 14C and 14*k* for accommodating respective toners of first specific color (V), second specific color (W), yellow (Y), magenta (M), cyan (C) and black (K) are provided at the upper side in the vertical direction in the first processor 10A and arranged side by side in the horizontal direction so as to be exchangeable. Furthermore, the first specific color and the second specific color are selected from specific colors (containing transparency) other than V, W, Y, M, C and K. Furthermore, in the following description, when Y, M, C and K are discriminated from one another, any alphabet of V, W, Y, M, C and K is added behind a numeral, and the description is made. When V, W, Y, M, C and K are not discriminated, V, W, Y, M, C and K are omitted.

Six image forming units 16 as examples of the image forming unit corresponding to the respective color toners are provided at the lower side of the toner cartridges 14 so as to be arranged side by side in the horizontal direction and correspond to the respective toner cartridges 14. Furthermore, exposure units 40 as example of the image forming unit are provided every image forming unit 16 at the lower side of the respective toner cartridges 14. The exposure units 40 receive from the controller 13 the image data which have been subjected to image processing, modulate semiconductor lasers (not shown) in accordance with color material gradation data, and emit exposure light L from these semiconductor lasers. Specifically, the surface of a photoconductor 18 (see FIG. 2) described later is irradiated with exposure light L corresponding to each color to form an electrostatic latent image on the photoconductor 18.

Figure 2:
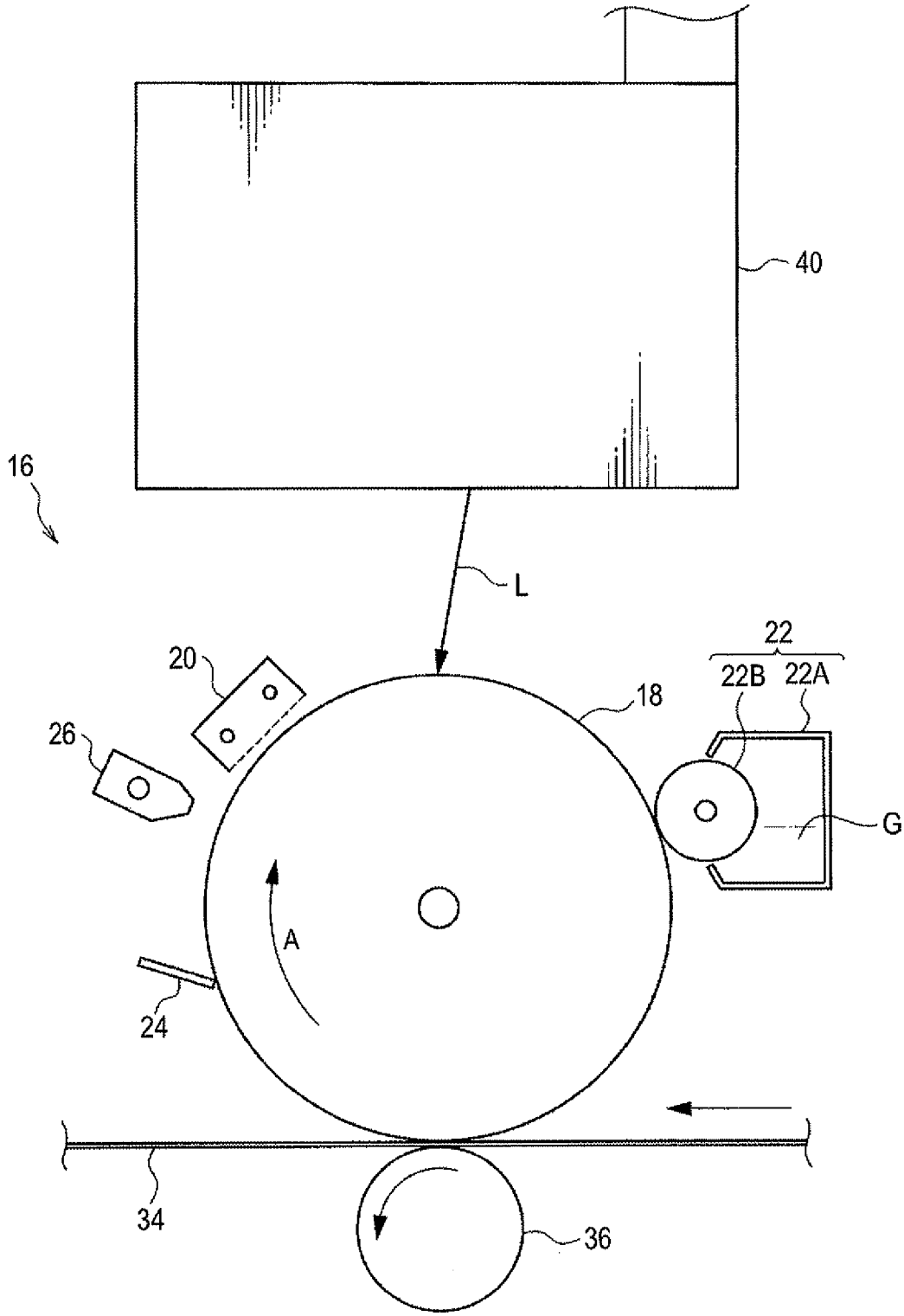
FIG. 2 is a diagram showing the configuration of an image forming unit according to the exemplary embodiment of the present invention.

As shown in FIG. 2, the image forming unit 16 has the photoconductor 18 which is rotated in the direction of an arrow A (clockwise in FIG. 2). Around the photoconductor 18 are provided a corona discharge type (non-contact charging type) scorotron charger 20 for charging the photoconductor 18, a developing device 22 for developing an electrostatic latent image formed on the photoconductor 18 with exposure light L emitted from the exposure unit 40 with each color developer (toner), a cleaning blade 24 for cleaning the surface of the post-transfer photoconductor 18, and an erase lamp 26 for irradiating the surface of the post-transfer photoconductor 18 with light to eliminate static electricity. The scorotron charger 20, the developing device 22, the cleaning blade 24 and the erase lamp 26 are successively disposed in this order from the upstream side to the downstream side with respect to the rotational direction of the photoconductor 18 so as to face the surface of the photoconductor 18.

Furthermore, the developing device 22 is disposed at a side of the image forming unit 16 (the right side on the paper surface in this embodiment), and it is configured to contain a developer stock member 22A filled with developer G containing toner and a developing roll 22B for moving the toner filled in the developer stock member 22A onto the surface of the photoconductor 18. The developer stock member 22A is connected to the toner cartridge 14 (see FIG. 1) through a toner supply path (not shown), and supplied with toner from the toner cartridge 14.

As shown in FIG. 1, a transfer unit 32 is provided at the lower side of each image forming unit 16. The transfer unit 32 is configured to contain an endless intermediate transfer belt 34 which comes into contact with each photoconductor 18, and six primary transfer rolls 36 as primary transfer members that are disposed inside the intermediate transfer belt 34 and transferring toner images formed on the respective photoconductors 18 onto the intermediate transfer belt 34 while multiplexing the toner images. The intermediate transfer belt 34 is wound around a driving roller 38 driven by a motor (not shown), a tension applying roll 41 for adjusting the tension of the intermediate transfer belt 34, a support roll 42 disposed so as to face a secondary transfer roll 62 described later, and plural support rolls 44, and it is circularly moved in the direction of an arrow B (counterclockwise) in FIG. 1 by the driving roll 38.

Specifically, each primary transfer roll 36 is disposed so as to face the photoconductor 18 of each corresponding image forming unit 16 through the intermediate transfer belt 34. A transfer bias voltage having the opposite polarity to the toner polarity is applied to the primary transfer roll 36 by a power supply unit (not shown). With this configuration, the toner image formed on the photoconductor 18 is transferred onto the intermediate transfer belt 34. A cleaning blade 46 which comes into contact with the intermediate transfer belt 34 at the tip portion thereof is provided at the opposite side to the driving roll 38 with respect to the intermediate transfer belt 34, and the cleaning blade 46 removes remaining toner, paper powder, etc. on the circularly moving intermediate transfer belt 34.

Furthermore, two large-size sheet supply cassettes 48 in which sheet members P as an example of a recording medium are stocked are provided below the transfer unit 32 at the lower side of the first processor 10A so as to be aligned with each other in the horizontal direction, and a stack of sheet members P can be stocked in each sheet supply cassette 48. The two sheet supply cassettes 48 have the same configuration. Therefore, only one sheet supply cassette 48 will be described, and the description of the other sheet supply cassette 48 is omitted.

The sheet supply cassette 48 can be freely drawn out from the first processor 10A. When the sheet supply cassette 48 is drawn out from the first processor 10A, a bottom plate 50 which is provided in the sheet supply cassette 48 and on which sheet members P are set descends in response to an instruction of a controller (not shown). When the bottom plate 50 descends, a user is allowed to replenish sheet members P. When the sheet supply cassette 48 is attached to the first processor 10A, the bottom plate 50 ascends in response to an instruction of the controller. A feed-out roll 52 for transporting a sheet member P from the sheet supply cassette 48 to a transporting path 60 is provided at the upper side of one end side of the sheet supply cassette 48, and the uppermost sheet member P set on the ascending bottom plate 50 comes into contact with the feed-out roll 52. Furthermore, a separating roll 56 for preventing sheet members P from being fed with being overlapped with each other is provided at the downstream side in the sheet member transporting direction of the feed-out roll 52 (hereinafter merely referred to as "downstream side"), and plural transporting rolls 54 for transporting a sheet member P to the downstream side in the transporting direction are provided at the downstream side of the separating roll 56.

The transporting path 60 provided at the upper side of the sheet feed cassette 48 extends so as to turn a sheet member P fed out from the sheet supply cassette 48 to the opposite side (to the left side in FIG. 1) at a first turning portion 60A and then turn the sheet member P to the opposite side (to the right side in FIG. 1) at a second turning portion 60B, and further extends to a transfer position T sandwiched between the secondary transfer roll 62 and the support roll 42.

An aligner (not shown) for correcting the tilt, etc. of the sheet member P being fed is provided at a site between the second returning portion 60B and the transfer position T, and also positioning rolls 64 for matching the carrying timing of a toner image on the intermediate transfer belt 34 with the transporting timing of the sheet member P is provided at a site between the aligner and the transfer position T.

Furthermore, a transfer bias voltage having the opposite polarity to the toner polarity is applied to the secondary transfer roll 62 by the power supply unit (not shown). With this configuration, respective color toner images which are transferred and multiplexed on the intermediate transfer belt 34 are secondarily transferred onto a sheet member P which is transported along the transporting path 60 by the secondary transfer roll 62. Furthermore, a preliminary path 66 extending from the side surface of the first processor 10A is provided so as to converge with the second returning portion 60B of the transporting path 60, so that a sheet member P fed out from an external large-capacity integrating unit (not shown) disposed adjacently to the first processor 10A is passed through the preliminary path 66 and enters the transporting path 60.

Plural transporting devices 70 for transporting a sheet member P having toner images transferred thereto to the second processor 10B are provided at the downstream side of the transfer position T. The transporting devices 70 have plural belt members wound around driving rolls and driven rolls (not shown), and the driving rolls are rotationally driven to rotate the belt members, whereby the sheet member P is transported to the downstream side.

Each of the downstream side of the transporting devices 70 extends from the first processor 10A to the second processor 10B, and the sheet member P fed out by the transporting device 70 is received by a transporting device 80 provided to the second processor 103, and further transported to the downstream side. Furthermore, a fixing unit 82 as an example of a fixing device for applying heat and pressure to the toner image transferred on the surface of the sheet member P so that the toner image concerned is fixed onto the sheet member P. A heat insulation structure 100 described later is provided at the upper side of the fixing unit 82.

Figure 3:
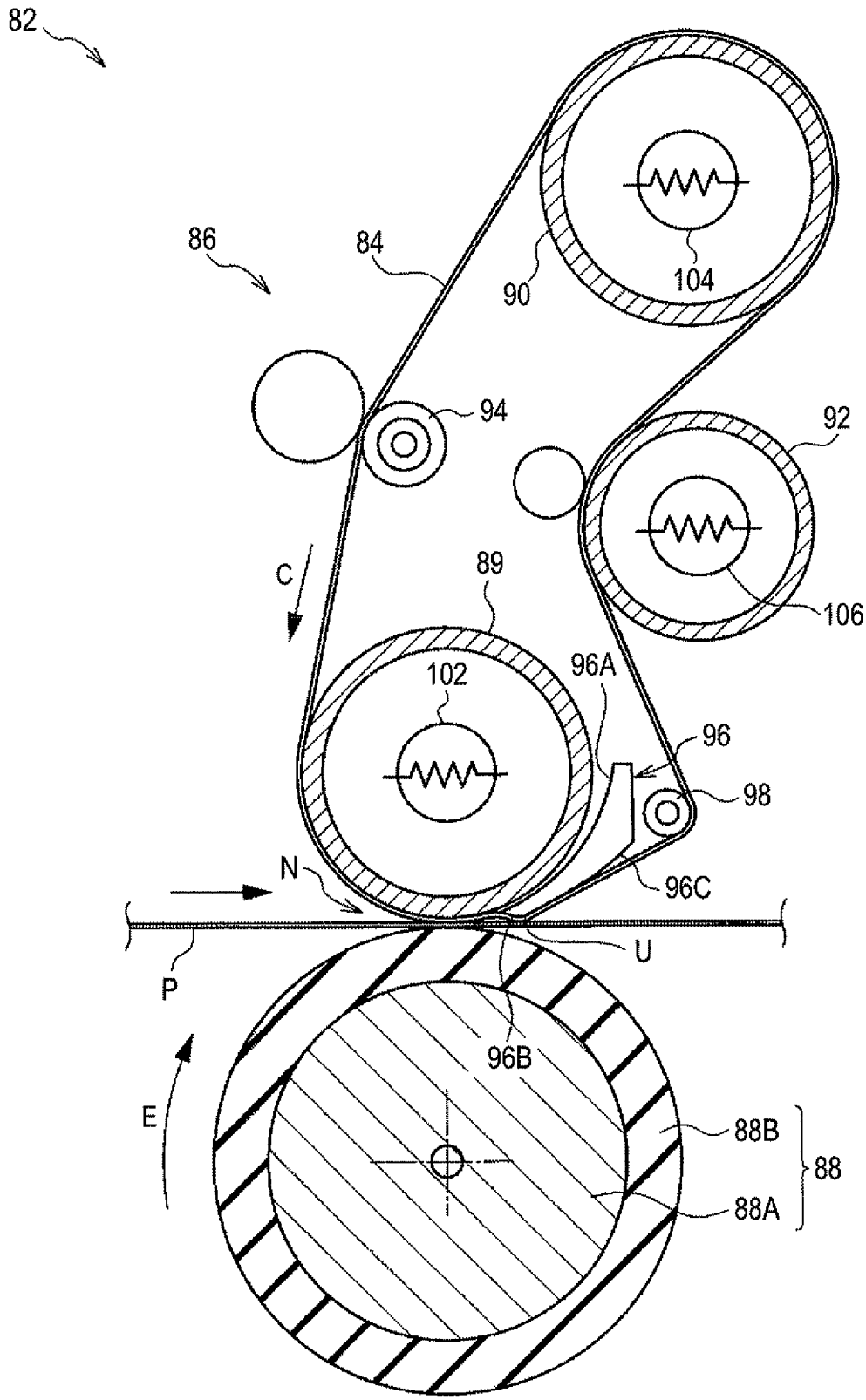
FIG. 3 is a diagram showing the configuration of a fixing unit according to the exemplary embodiment of the present invention.

As shown in FIG. 3, the fixing unit 82 includes a fixing belt module 86 having a fixing belt 84, and a pressurizing roll 88 disposed so as to be pressed against the fixing belt module 86. The fixing unit 82 is provided with a nip portion N at which the sheet member P is pressurized and heated by the fixing belt module 86 and the pressurizing roll 88 to fix the toner image.

The fixing belt module 86 has the endless fixing belt 84, a heating roll 89 which is rotationally driven by the rotational force of a motor (not shown) while tensing the fixing belt 84 at the pressurizing roll 88 side, and a support roll 90 for tensing the fixing belt 84 from the inside at a position different from the heating roll 89. Furthermore, the fixing belt module 86 is provided with a support roll 92 which is disposed at the outside of the fixing belt 84 and defines a revolving path of the fixing belt 84, and an attitude correcting roll 94 for correcting the attitude of the fixing belt 84 from the heating roll 89 till the support roll 90.

An exfoliating pad 96 and a support roll 98 are provided at the downstream area in the nip portion N as the pressure-contact area between the fixing belt module 86 and the pressurizing roll 88 and also at the inside of the fixing belt 84. Specifically, the exfoliating pad 96 is disposed in the neighborhood of the heating roll 89 to exfoliate the fixing belt 84 from the outer peripheral surface of the heating roll 89, and the support roll 98 around which the fixing belt 84 is wound under tension is provided at the downstream side of the nip portion N.

The heating roll 89 is a hard roll having a cylindrical metal core formed of aluminum and a protection layer formed on the surface of the metal core to prevent metal abrasion of the metal core. The protection layer is formed of fluorocarbon resin coating of 200 μm in thickness. A halogen heater 102 as a heating unit is provided in the heating roll 89. The support roll 90 is a cylindrical roll formed of aluminum, and a halogen heater 104 is provided as a heating source in the support roll 90 to heat the fixing belt 84 from the inner surface side. Sprint members (not shown) for pressing the fixing belt 84 outwardly are provided at both the end portions of the support roll 90.

The support roll 92 is a cylindrical roll formed of aluminum, and a releasing layer formed of fluorocarbon resin of 20 μm in thickness is formed on the surface of the support roll 92. The release layer is formed to prevent a slight amount of offset toner or paper powder from the outer peripheral surface of the fixing belt 84 from accumulating on the support roll 92. A halogen heater 106 as a heating unit is also provided in the support roll 92 to heat the fixing belt 84 from the outer peripheral surface side. That is, in this embodiment, the fixing belt 84 is heated by the heating roll 89 and the support rolls 90 and 92.

The attitude correcting roll 94 is a cylindrical roll formed of aluminum, and an end portion position measuring mechanism (not shown) for measuring the end portion position of the fixing belt 84 is disposed in the neighborhood of the attitude correcting roll 94. The attitude correcting roll 94 is provided with an axis displacing mechanism (not shown) for displacing a mating position in the axial direction of the fixing belt 84 in accordance with a measurement result of the end portion position measuring mechanism to control meandering of the fixing belt 84.

The exfoliating pad 96 is, for example, a block-shaped member which includes a rigid member formed of iron type metal, resin or the like and has the length corresponding to the heating roll 89. The exfoliating pad 96 is designed to be substantially arcuate in cross section, and has an inner face 96A, which is curved so as to face the heating roll 89, a press face 96B for pressing the fixing belt 84 against the pressurizing roll 88, and an outer face 96C for bending the fixing belt 84 at a predetermined angle with the press face 96B. Specifically, a corner portion U including the press face 96B and the outer face 96C bends the fixing belt 84 which is pressed against the corner portion U by the pressurizing roll 88, and exfoliates the tip of the sheet member P and the fixing belt 84 from each other when the tip of the sheet member P is passed over the corner portion U.

The pressurizing roll 88 has a cylindrical roll 88A formed of aluminum as a base body, an elastic layer 88B formed of silicon rubber and an exfoliating layer which is formed of fluorocarbon resin and has a thickness of 100 μm. The elastic layer 88B and the exfoliating layer are successively laminated in this order from the base body side. The pressurizing roll 88 is freely rotatably supported, and an urging unit such as a spring or the like (not shown) brings the pressurizing roll 88 into press-contact with a site at which the fixing belt 84 is wound around the heating roll 89. Accordingly, in connection with the rotational movement of the heating roll 89 of the fixing belt module 86 in the direction of an arrow C, the pressurizing roll 88 is driven to rotate in the direction of an arrow E while following the rotation of the heating roll 89.

As shown in FIG. 1, a transporting device 108 for transporting a sheet member P fed out from the fixing unit 82 to the downstream side is provided at the downstream side of the fixing unit 82, and a cooling unit 110 for cooling the sheet member P heated by the fixing unit 82 is provided at the downstream side of the transporting device 108. The cooling unit 110 is provided with a heat absorbing device 112 for absorbing heat of a sheet member P and a pressing device 114 for pressing the sheet member P being transported against the heat absorbing device 112. The heat absorbing device 112 and the pressing device 114 are disposed at the upper and lower sides respectively so as to sandwich the transporting path 60 therebetween. Furthermore, a decurling unit 140 for rectifying warp (curl) of the sheet member P is provided at the downstream side of the cooling unit 110.

The heat absorbing device 112 is provided with an endless heat absorbing belt 116 which comes into contact with a sheet member P and absorbs heat of the sheet member P, and also plural support rolls 118 for supporting the heat absorbing belt 116, and a driving roll 120 for transmitting driving force to the heat absorbing belt 116 are provided inside the heat absorbing belt 116. Furthermore, a heat sink 122 formed of aluminum material is provided inside the heat absorbing belt 116, and the heat sink 122 comes into planar contact with the heat absorbing belt 116 so that the heat absorbed by the heat absorbing belt 116 is radiated.

The pressing device 114 is provided with an endless press belt 130 that comes into contact with a sheet member P to press the sheet member P against the heat absorbing device 112, and plural support rolls 132 around which the press belt 130 are wound under tension so as to be revolvable. With this configuration, the heat of the sheet member P is drawn and the sheet member P is cooled.

A discharge roll 198 for discharging a sheet member P having an image formed on one surface thereof to a discharging unit 196 which is secured to the side surface of the second processor 10B. Here, when images are formed on both the surfaces of a sheet member P, the sheet member P is transported to a reversing unit 200 provided downstream of the decurling unit 140.

The reversing unit 200 is provided with a reversing path 202. The reversing path 202 has a branch path 202A branching from the transporting path 60, a sheet transporting path 202B for transporting a sheet member P transported along the branch path 202A to the first processor 10A side, and a reversing path 202C for turning the sheet member P transported along the sheet transporting path 202B in the opposite direction for switchback transport, thereby turning over the sheet member P. With this configuration, the sheet member P which is subjected to switchback transport through the reversing path 2020 is transported to the first processor 10A, fed into the transporting path 60 provided at the upper side of the sheet supply cassette 48 and then fed to the transfer position T again.

Next, the heat insulation structure 100 will be described.

Figure 4:
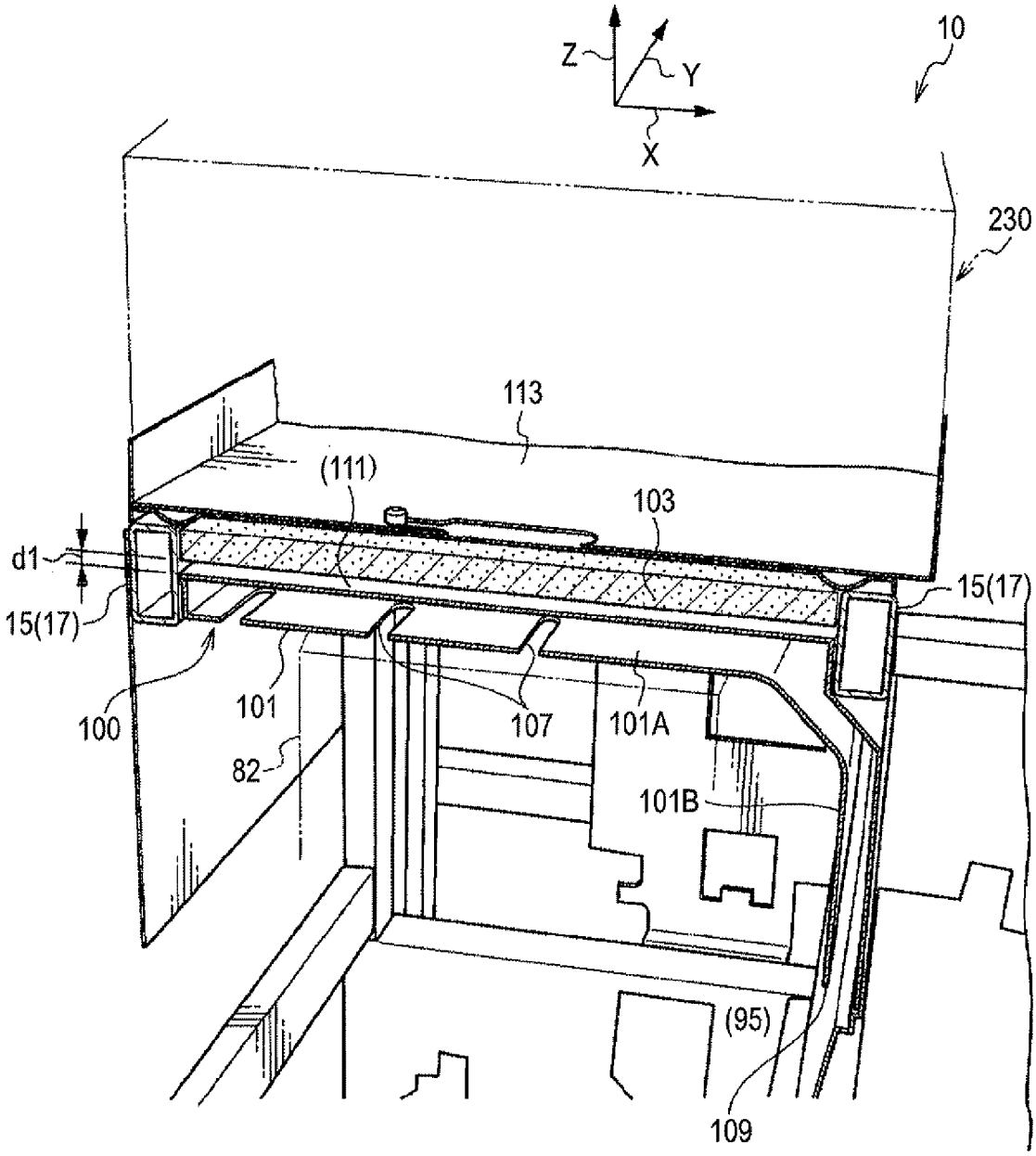
FIG. 4 is a diagram showing the configuration of a heat insulation structure according to the exemplary embodiment of the present invention.
Figure 7:
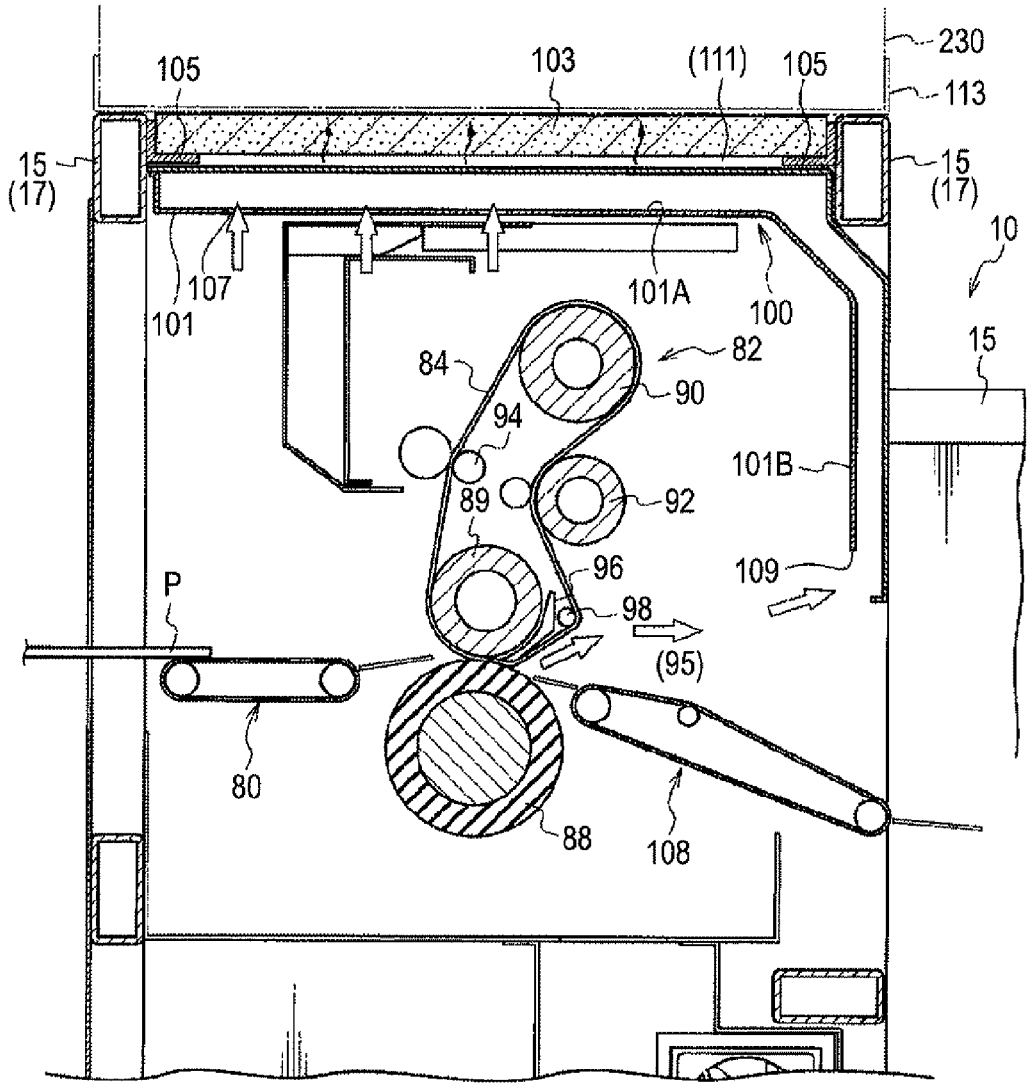
FIG. 7 is a diagram showing a heat insulation state based on the heat insulation structure according to the exemplary embodiment of the present invention.

As shown in FIG. 1, the heat insulation structure 100 is provided at the upper side of the fixing unit 82. As shown in FIGS. 4 and 7, the heat insulation structure 100 includes an exhaust duct 101 as an example of a flow path member through which air to be exhausted to the outside of the second processor 10B flows, a heat insulating member 103 disposed at the upper side of the exhaust duct 101, and reinforcing members 105 as an example of a gap forming member through which the heat insulating member 103 is spaced from the exhaust duct 101 at a distance d1 to form a gap 111.

The exhaust duct 101 is configured by a tubular member having an L-shaped cross-section which covers the whole area from the upper side of the fixing unit 82 till the feed-out portion 95 of the fixing unit 82 for the sheet member P in front view of the image forming apparatus 10 and extends to the back side of the image forming apparatus 10 (in the direction of a Y arrow in FIG. 4). The exhaust duct 101 is provided with plural air suction holes 107 which are formed in a bottom portion 101A facing the upper portion of the fixing unit 82 so that the longitudinal direction of the air suction holes 107 correspond to the air exhaust direction (the direction of the arrow Y), and also an air suction port 109 is formed in a side portion 101B facing the feed-out portion 95 so as to be opened to the feed-out portion 95.

Here, an exhaust fan (not shown) which is rotated to set the internal pressure of the exhaust duct 101 to negative pressure is provided at the end portion of the back side of the exhaust duct 101, and through the exhaust operation of the exhaust fan, air is sucked at the upper side of the fixing unit 82, passed through the exhaust duct 101 and then exhausted to the outside of the second processor 10B. The exhaust duct 101 may be formed of resin or metal. Furthermore, a frame portion 17 is provided at the upper side of the exhaust duct 101, and the frame portion 17 is configured by four (eight when corner portions are contained) frame members 15 which are assembled in a rectangular shape in plan view as shown in FIG. 5.

Figure 6:
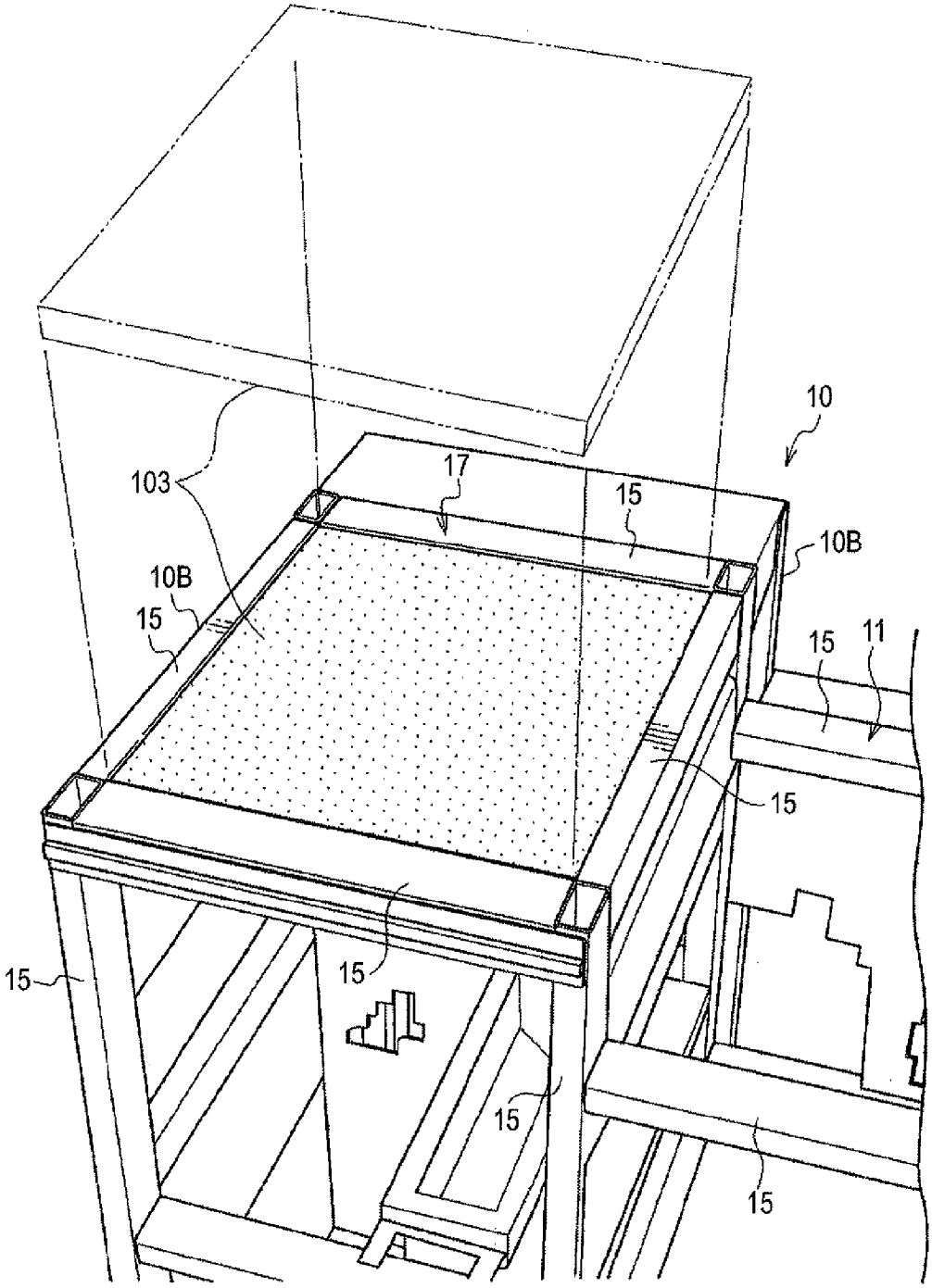
FIG. 6 is a perspective view showing a fixing state of a heat insulation member according to the exemplary embodiment of the present invention.

For example, the heat insulating member 103 is formed of planar urethane foam and designed to have a thickness of several tens mm (20 mm) in the direction of an arrow Z. As shown in FIGS. 6 and 7, the size of the heat insulating member 103 is set so that the heat insulating member 103 can be fitted in the site (space) surrounded by the frame portion 17. As shown in FIG. 7, a support plate 113 having a U-shaped cross-section is fixed onto the frame members 15 (frame portion 17) surrounding the heat insulating member 103 at the upper side of the heat insulating member 103 so as to be opened upwardly. The power supply unit 230 described above is mounted on the support plate 113.

Figure 5:
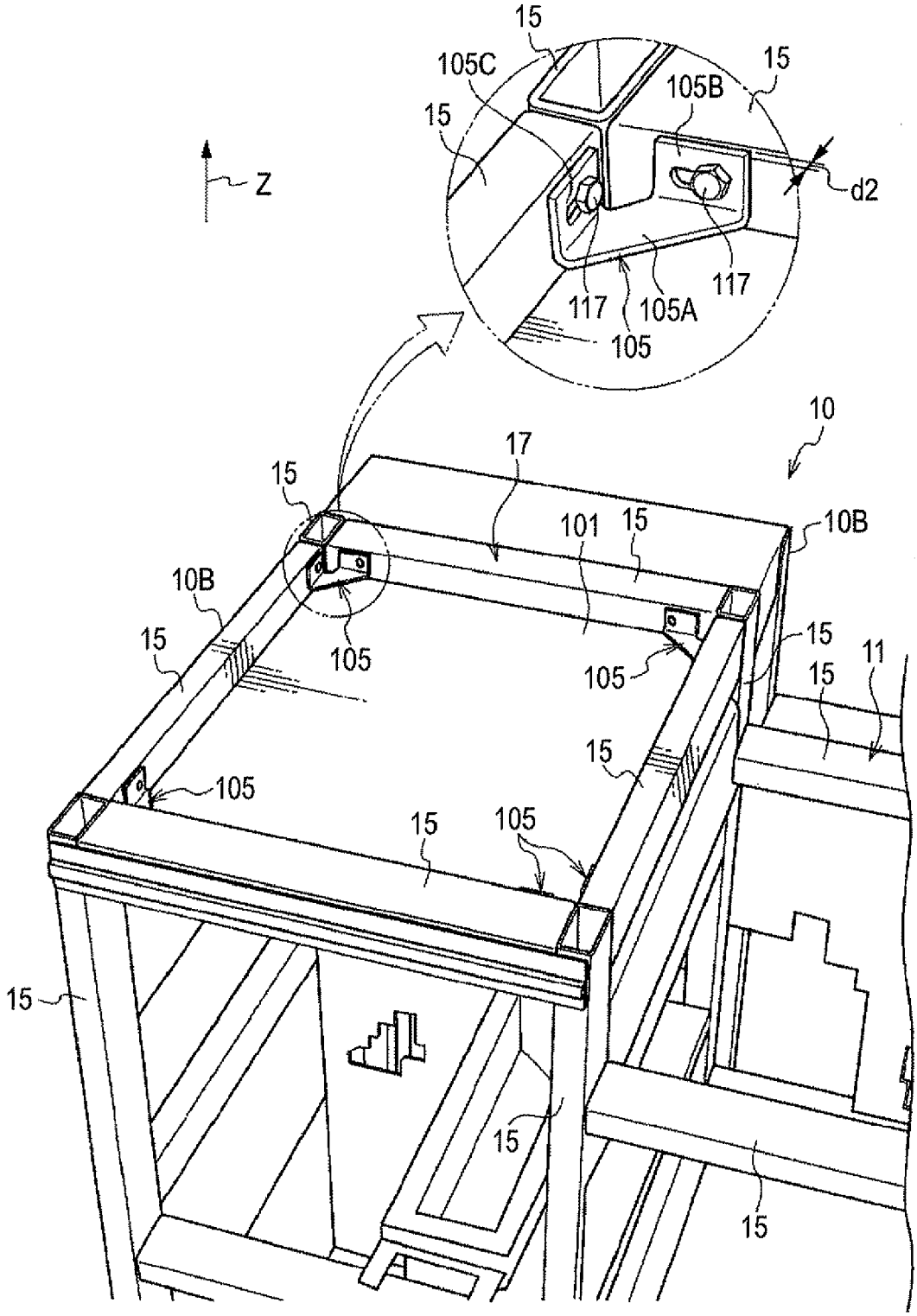
FIG. 5 is a perspective view showing a fixing sate of a reinforcing member of the heat insulation structure according to the exemplary embodiment of the present invention.

Furthermore, as shown in FIG. 5, the reinforcing member 105 is configured by bending a plate member having a thickness of d2 at two places, and it has a trapezoidal bottom portion 105A in plan view, and fixing portions 10513 and 105C which are erected from the bottom portion 105A in the direction of the arrow Z and positionally displaced from each other by 90° in plan view. The thickness of d2 may be substantially equal to the distance d1 in FIG. 4. The bottom portion 105A is disposed on the exhaust duct 101, and the fixing portions 105E and 105C of each reinforcing member 105 are fastened and fixed to both the inner side surfaces of the frame portion 17 sandwiching each of the four corner portions by bolts 117. A ceiling member (for example, metal plate) may be provided at the upper portion of the exhaust duct 101 so that the bottom portion 105A is disposed on the ceiling member.

Here, as shown in FIG. 5, the reinforcing members 105 are fixed to the frame portion 17 by the bolts 117 in the image forming apparatus 10. The respective frame members 15 are joined to one another by the reinforcing members 105, whereby the rigidity of the second processor 10B can be enhanced.

Subsequently, as shown in FIGS. 5 and 6, the heat insulating member 103 is fitted into the inner space of the frame portion 17. At this time, the four corners of the heat insulating member 103 are supported by the bottom portion 105A of the reinforcing members 105, and thus the interval of the gap 111 between the exhaust duct 101 and the heat insulating member 103 is equal to the distance d1. In this case, the distance d1 may be substantially equal to the thickness d2 of the reinforcing member 105. As described above, the heat insulation structure 100 is configured by the exhaust duct 101, the heat insulating member 103 and the reinforcing members 105. The gap 111 is formed by the reinforcing member 105, and thus it is unnecessary to separately provide a part for forming the gap.

Next, the action of this embodiment will be described.

First, an image forming process of the image forming apparatus 10 will be described.

As shown in FIG. 1, when each unit of the image forming apparatus 10 falls into an actuation state, image data which are subjected to image processing in the controller 13 are converted to color material gradation data of respective colors, and successively output to the exposure units 40. In each exposure unit 40, each exposure light L is emitted in accordance with the color material gradation data of each color, and each photoconductor 18 charged by the scorotron charger 20 (see FIG. 2) is subjected to scanning exposure to form an electrostatic latent image. The electrostatic images formed on the respective photoconductors 18 (see FIG. 2) are visualized into respective color toner images (developer images) with first specific color (V), second specific color (W), yellow (Y), magenta (M), cyan (C) and black (K) by the developing devices 22, thereby performing the developing operation.

Subsequently, the respective color toner images which are successively formed on the photoconductors 18 of the respective forming units 16V, 16W, 16Y, 16M, 16C and 16K are successively transferred and multiplexed onto the intermediate transfer belt 34 by the six primary transfer rolls 36V, 36W, 36Y, 36M, 36C and 36K. The respective color toner images which are transferred and multiplexed onto the intermediate transfer belt 34 are secondarily transferred onto a sheet member P transported from the sheet supply cassette 48 by the secondary transfer roll 62. The sheet member P having the toner image transferred thereto is transported to the fixing unit 82 provided in the second processor 10B by the transporting device 70.

Subsequently, each color toner image on the sheet member P is heated and pressurized by the fixing unit 82, whereby the respective color toner images are fixed on the sheet member P. Furthermore, the sheet member P having the toner image fixed thereon is passed and cooled through the cooling unit 110, and then fed into the decurling unit 140 to rectify warp of the sheet member P. Then, the warp-rectified sheet member P is discharged to the discharge unit 196 by the discharge roll 198.

When an image is formed on a non-image surface on which no image is formed (in the case of double-side printing), the sheet member P is fed out to the reversing unit 200 by a switching member (not shown). The sheet member P fed out to the reversing unit 200 is passed through the reversing path 202, whereby the sheet member P is turned over (reversed). The reversed sheet member P is fed into the transporting path 60 provided at the upper side of the sheet supply cassette 48, and a toner image is formed on the back surface of the sheet member P concerned according to the procedure described above.

Next, the heat insulation action of the heat insulation structure 100 will be described.

As shown in FIG. 7, when the image forming apparatus 10 is actuated and the fixing processing in the fixing unit 82 is started, air around the fixing unit 82 is heated and the temperature is high. Here, when air exhaustion of the exhaust fan (not shown) of the exhaust duct 101 is started, the high-temperature air around the fixing unit 82 is sucked from the air suction hole 107 and the air suction port 109, made to flow through the exhaust duct 101, and then is exhausted to the outside of the second processor 10B, whereby diffusion of heat from the fixing unit 82 to other sites of the image forming apparatus 10 is reduced (first stage of heat insulation). Water vapor vaporizing from the sheet member P after fixing is also exhausted due to the air suction from the air suction port 109, and thus dew condensation hardly occurs.

Subsequently, the temperature of the air flowing in the exhaust duct 101 is high, and thus the temperature of the exhaust duct 101 increases. However, the gap 111 is formed between the exhaust duct 101 and the heat insulation member 103 by the reinforcing member 105. Therefore, the diffusion of heat to the heat insulation member 103 is further reduced by the heat insulation effect of the air of the gap 111 (second stage of heat insulation).

Subsequently, heat convention occurs in the gap 111. However, the heat diffusion is suppressed by the heat insulating member 103 at the upper side of the gap 111, and thus heat is hardly transmitted to the power supply unit 230 at the upper side of the heat insulating member 103 (third stage of heat insulation). As described above, the heat insulation structure 100 can suppress the temperature increase of the power supply unit 230 caused by the fixing unit 82 with the heat insulation actions of the three stages.

The present invention is not limited to the above exemplary embodiment.

For example, the exhaust duct 101 may be designed so that the bottom portion thereof is formed of resin and the ceiling portion thereof is formed of metal. Furthermore, not only the power supply unit 230, but also, for example, the developing unit, the toner cartridge or the image forming unit 16 in which toner is easily affected by heat may be targeted as functional members. Not only urethane foam, but also heat insulation materials such as glass wool, rock wool, silica, quartz glass, phenol foam, polystyrene, polystyrene foam, etc. may be used for the heat insulating member 103.

Furthermore, the size of the gap 111 is not limited to the thickness of the reinforcing member 105, and the gap 111 may be enlarged (adjusted) by fixing the reinforcing member 105 at a higher position which is upwardly spaced from the exhaust duct 101, for example. The number of exhaust ducts 101 is not limited to one, but plural exhaust ducts may be provided while distributed to the air suction hole 107 side and the air suction port 109 side.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heat insulation structure comprising:

a duct member disposed above a fixing device that fixes developer onto a recording medium, through which air flows to be exhausted;

a heat insulating member disposed between an upper side of the duct member and a lower side of a function member, the function member being disposed above the duct member; and a gap forming member that forms a gap between the duct member and the heat insulation member in a vertical direction.

2. The heat insulation structure according to claim 1, wherein a housing of the fixing device has a frame unit disposed above the duct member, and the gap forming member is a reinforcing member that joins both sides adjacent to each corner of the frame unit to reinforce the frame unit.

3. An image forming apparatus comprising:

an image forming unit that forms an image on a recording medium with developer;

a fixing device that is disposed downstream of the image forming unit in a transporting direction of a recording medium and fixes the developer onto the recording medium; and a heat insulation structure, the heat insulation structure comprising;

a duct member disposed above a fixing device that fixes developer onto a recording medium, through which air flows to be exhausted;

a heat insulating member disposed between an upper side of the duct member and a lower side of a function member, the function member being disposed above the duct member; and a gap forming member that forms a gap between the duct member and the heat insulation member in a vertical direction.

4. The image forming apparatus according to claim 3, wherein a housing of the fixing device has a frame unit disposed above the duct member, and the gap forming member is a reinforcing member that joins both sides adjacent to each corner of the frame unit to reinforce the frame unit.

* * * * *